US005670074A

United States Patent [19]

Kass et al.

[11] Patent Number: 5,670,074

[45] Date of Patent: Sep. 23, 1997

[54] HEATING SYSTEM SHUT-OFF SYSTEM WITH RADIO/ULTRASOUND COMMUNICATION BETWEEN DETECTOR AND EXISTING SAFETY SWITCH OR FUEL VALVE

[76] Inventors: Carl F. Kass, P.O. Box 346, Cragsmoor, N.Y. 12420; Arthur W. Little, 19 Scan St., Napanoch, N.Y. 12458

[21] Appl. No.: 374,021

[22] Filed: Jan. 18, 1995

[51] Int. Cl.[6] ..... H05B 1/02

[52] U.S. Cl. ..... 219/481; 219/502; 219/497; 219/506; 340/825.69; 340/825.72

[58] Field of Search ..... 219/481, 502, 219/488, 497, 506, 501, 494; 340/825.36, 825.69, 825.72

[56] References Cited

U.S. PATENT DOCUMENTS

| | | | |
|---|---|---|---|
| 4,659,909 | 4/1987 | Knutson | 219/452 |
| 4,818,970 | 4/1989 | Natale et al. | 340/539 |
| 4,959,647 | 9/1990 | Daigle | 340/825.72 |
| 4,969,508 | 11/1990 | Tate et al. | 165/22 |
| 5,189,392 | 2/1993 | Kass et al. | 340/521 |
| 5,511,553 | 4/1996 | Segalowitz | 128/696 |

*Primary Examiner*—Mark H. Paschall

*Attorney, Agent, or Firm*—Jay H. Maioli

[57] ABSTRACT

A safety apparatus for shutting off a unit having a manually operated power interruption switch or fuel supply valve upon detecting a predetermined condition where the condition is detected remotely from the location of the switch or valve. The sensor for detecting the predetermined condition communicates with a receiver that contacts an actuator for opening the interrupt switch or closing the fuel supply valve without an interconnecting electrical wire.

9 Claims, 3 Drawing Sheets

HEATING SYSTEM SHUT-OFF SYSTEM WITH RADIO/ULTRASOUND COMMUNICATION BETWEEN DETECTOR AND EXISTING SAFETY SWITCH OR FUEL VALVE

BACKGROUND OF THE INVENTION

1. Field of the Invention

This invention relates generally to a safety system for a home heating system or hot-water heater and, more particularly, to such safety system using a detecting device and an actuating device which operates on the existing manual power interruption switch of the heating system where the detecting and actuating devices communicate without an interconnecting electrical wire.

2. Description of the Background

One of the common hazards associated with the burning of fuel for the heating of a home or the heating of water used in the home is that the smoke and combustion gases resulting from such burning are not properly and safely vented to outside the home. This improper venting may be caused by many things, including the blocking of the chimney by animals or birds; the obstruction of the smoke passages within a heating system or boiler due to the accumulation of carbon and other combustion particles, which is especially true in newer, high-efficiency units with smaller passages; the disconnection of the heating system or boiler from the chimney due to the improper connection or repeated vibration of the connecting piping; and fire leaking from the boiler or heating system due to damage, or failure of the boiler or heating system.

There are many hazards associated with improperly vented smoke and combustion gasses, such as asphyxiation of the occupants of the structure by carbon monoxide and other combustion gasses, and the sooty accumulation of smoke within the house and on the contents. Also, if the smoke is the result of fire leakage, there is the chance that the leaking fire will eventually cause the structure to burn.

Almost all home heating systems, and many domestic water heaters, have a safety switch, usually located at the head of the basement stairway, so that the homeowner can interrupt the power to the heating system in case of an emergency. Typically, the homeowner or emergency worker smells smoke or notes some other malfunction and throws the switch, thereby interrupting the electrical supply to the heating system. This power interruption then shuts down the entire heating system. In the case of a gas or oil-fired heating system the supply of fuel to the combustion element is ultimately interrupted and the heating system stops functioning.

The use of residential smoke detectors has become widespread and the benefits of these devices are well known. Typically, when using a smoke detector, the occupant hears and/or sees the alarm and, in the case of a heating system problem, turns off the heating system using the safety shut-off switch, as described above.

A system that can interrupt the power to an electric range and that employs a smoke or flame detector has previously been described in U.S. Pat. No. 4,659,909. This system is wired into the power connection to the electric range, which typically does not have a safety shut-off switch of the kind provided for a heating system.

A system which can interrupt the electrical power or fuel supply to a home heating system in response to a detected environmental condition has been described in U.S. Pat. No. 5,189,392. That system relied on a low-voltage, low-current signal communicated by a wire from a detecting device, like a smoke detector, to a shut-off means.

Existing systems for shutting off home heating systems in the event of a malfunction have several drawbacks in terms of safety, performance and convenience. Where the shut-off switch or valve must be actuated manually, an occupant must be present to hear the alarm and may be subject to additional dangers in the event of a fire, combustion gas accumulation, or fuel gas leak.

In the case of electric range shut-off systems, a 120/240 volt supply line is used to trip a circuit breaker making it inconvenient or dangerous for a homeowner to install the system himself.

In the case where a low-voltage, low-current signal is used to actuate a shut-off switch or valve, the homeowner must install wiring between the detector mounted near the heating unit and the switch or valve actuator. Installation of wiring may be inconvenient especially where walls an flooring are finished. There is also a danger of improper installation or accidental breakage of the wire resulting in system failure.

OBJECT AND SUMMARY OF THE INVENTION

Accordingly, it is an object of the present invention to provide a safety shut-off system for a heating system or hot water heater that can eliminate the above noted defects inherent in previously known systems.

It is another object of the present invention to provide a system to sense the presence of smoke, combustion gases, fuel gases or heat in the environment of the heating system, and to cause the actuation of an existing power interruption safety switch or fuel line valve to interrupt power and/or fuel to the heating system where the power interrupt switch or fuel line valve is located at a distance from the heating system.

It is still another object of the present invention to provide a safety system for home heating units which detects faulty or dangerous conditions in the vicinity of the heating system and communicates that information to an actuating device attached to an existing power interruption switch or fuel shut-off valve without requiring the use of an additional electrical connection.

According to an aspect of the present invention a safety apparatus for shutting off a combustion unit having a manually operated switch or fuel supply valve comprises an environmental condition sensor located near the combustion unit and an actuator unit attached to the existing shut-off mechanism. The environmental sensor detects a faulty or dangerous condition and produces an omnidirectional signal such as an audio or ultrasonic sound, an infrared light signal or a radio or microwave signal. The signal is received by the actuator unit which operates the shut-off mechanism to cut off power and/or fuel supplied to the combustion unit.

According to another aspect of the present invention the environmental condition sensor detects a faulty or dangerous condition and sends a signal to the actuator unit through a fiber-optic cable.

The above and other objects, features and advantages of the present invention will become apparent from the following detailed description of illustrative embodiments thereof to be read in conjunction with the accompanying drawings, in which numerals represent the same or similar elements.

DETAILED DESCRIPTION OF THE PREFERRED EMBODIMENTS

Figure 1:
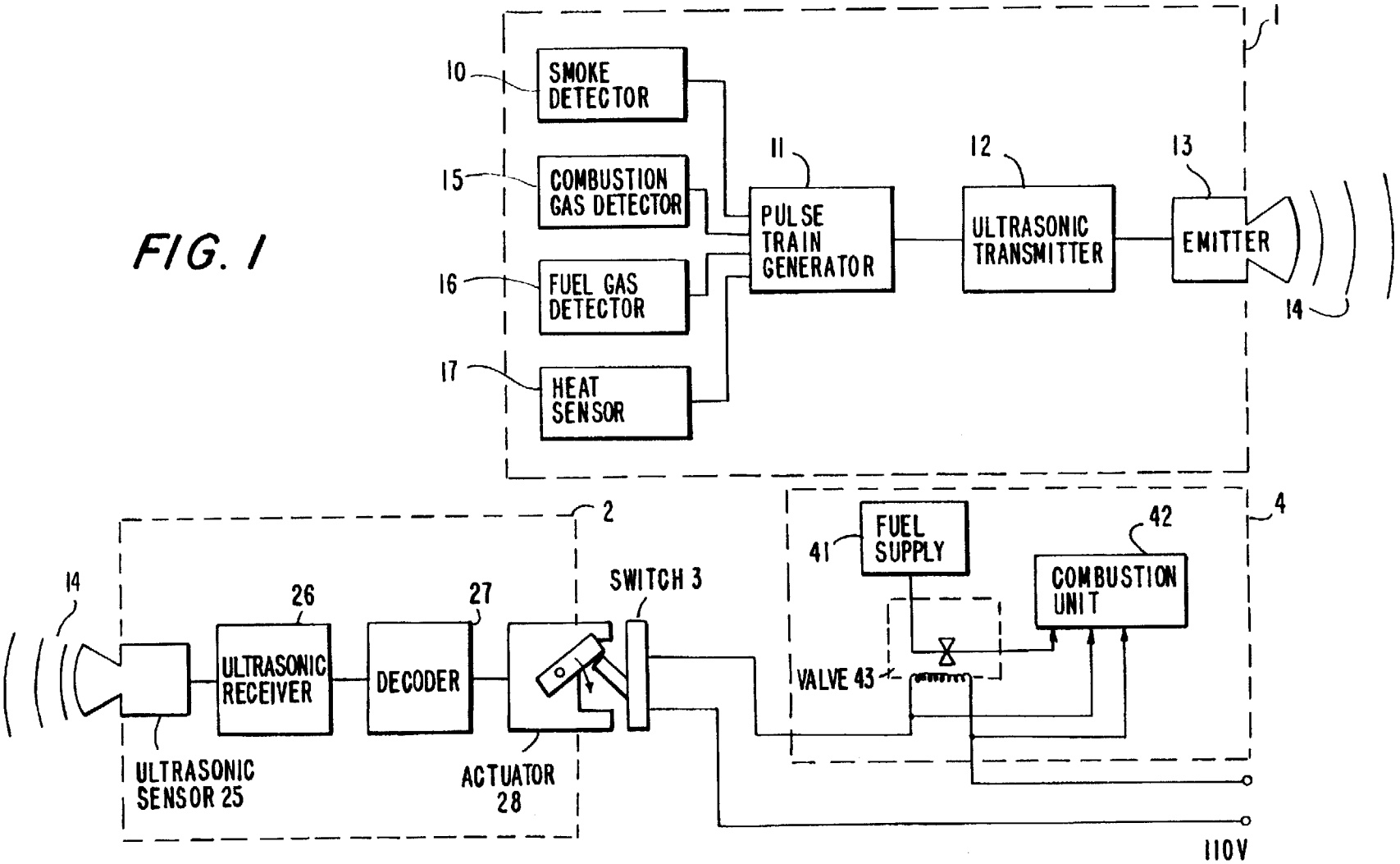
FIG. 1 is a block diagram of a safety shut-off apparatus for actuating an emergency cut-off switch of a combustion unit according to an embodiment of the present invention.

FIG. 1 shows a system for automatically operating an emergency shut-off switch of a home heating unit or water heater according to a first embodiment of the present invention. A condition detecting unit 1 is located near the heating unit 4. When one of the smoke detector 10, combustion gas detector 15, fuel gas detector 16 or heat sensor 17 comprising the condition detecting unit 1 detects a faulty or dangerous condition it sends a signal to a pulse train generator 11 which produces a series of pulses in a predetermined coded pattern. An ultrasonic transmitter 12 generates an series of ultrasonic tones corresponding to the signal from the pulse train generator 11. These tones 14 are broadcast by the emitter 13.

The tones 14 are received by an ultrasonic sensor 25, located in the actuator unit 2 which is mounted to the existing power cut-off switch 3. An ultrasonic receiver 26 demodulates the coded ultrasonic signal into a series of digital logic level pulses which are sent to a decoder 27. The decoder compares the series of digital pulses from the ultrasonic receiver 26 with the pattern expected to be generated by the pulse train generator 11. When the decoder 27 finds a pattern of digital pulses from the ultrasonic receiver 26 which match the pattern expected from the pulse train generator 11 it sends a signal to the actuator 28 to throw the existing cut-off switch 3 thereby cutting off electrical power to the combustion unit 42. The interruption of electrical power to the fuel supply valve 43 cuts off fuel supplied to the combustion unit 42.

Since the condition detecting unit 1 and the actuator unit 2 communicate via a broadcast signal there is no need for the installation of additional electrical wiring between them. This simplifies installation by the homeowner and prevents failures due to improper installation. Also, the broadcast signal is not vulnerable to breakage as a hard-wire system might be.

The use of a predetermined series of pulses to communicate between the condition detecting unit 1 and the actuator 2 reduces the possibility that the actuator will be activated by environmental noise.

This embodiment of the present invention contemplates that the broadcast signal might be an audio-frequency tone, an infrared light signal or a radio- or microwave-frequency signal. In these cases the ultrasonic generator 12, emitter 13, ultrasonic sensor 25, and ultrasonic receiver 26 will be replaced with functionally equivalent devices for those modes of communication.

This embodiment provides a means whereby multiple condition detecting units 1 can cause a single actuating unit 2 to cut off electrical power or fuel to a combustion unit. For example, one detecting unit is placed in the attic near the chimney to detect the leakage of combustion gases, flames or heat. Another detecting unit is placed at a low point in the basement to detect the accumulation of heavier-than-air fuel gases. The actuator unit is responsive to signals from both detection units and shuts off the combustion unit if dangerous conditions are detected at either location.

Figure 2:
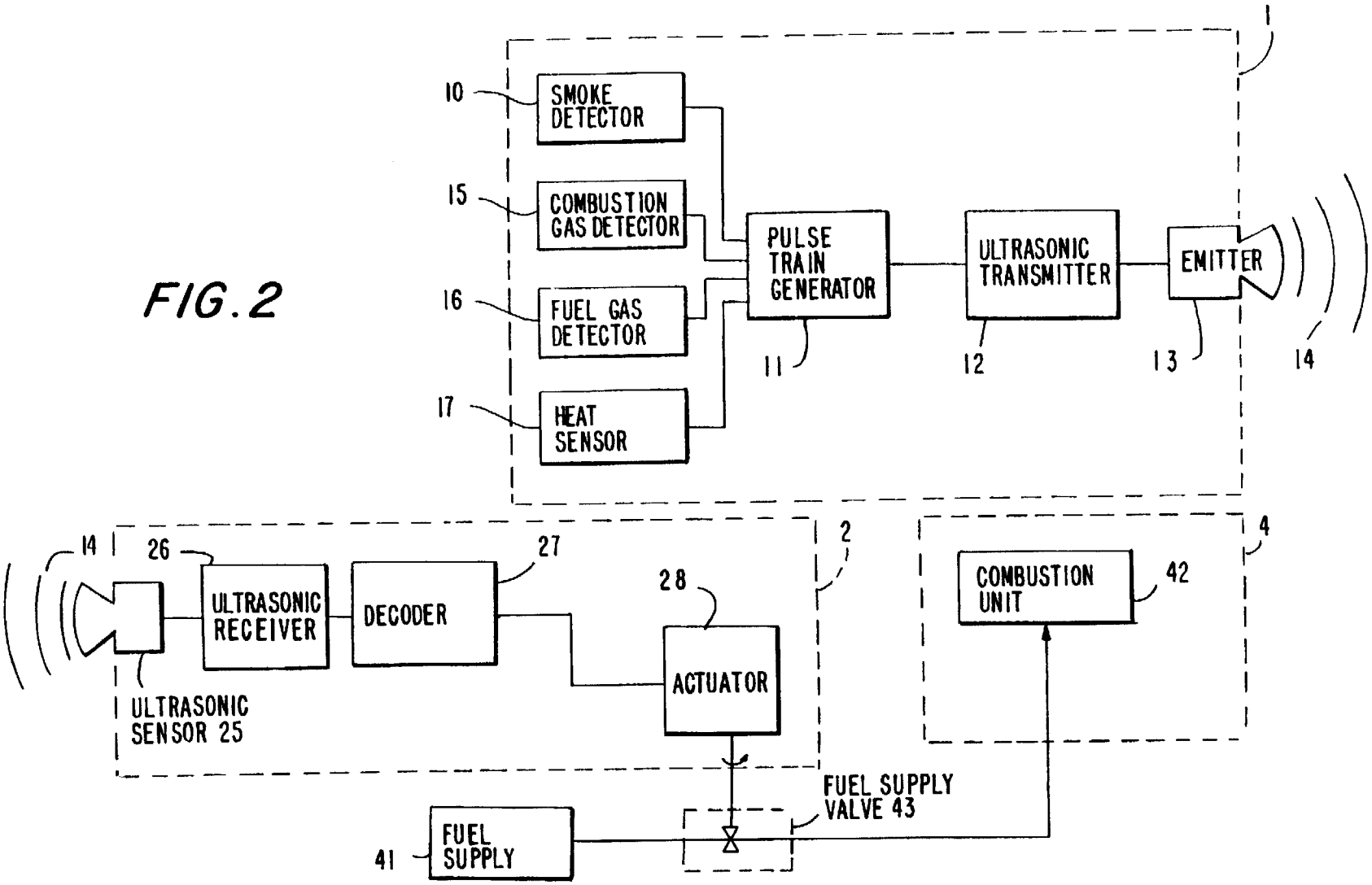
FIG. 2 is a block diagram of a safety shut-off apparatus for actuating a fuel supply valve to cut off the fuel supply of a combustion unit according to a second embodiment of the present invention.

FIG. 2 shows a second embodiment of the present invention applicable to heating systems with a manually operated fuel shut-off valve. The condition detecting unit 1 and actuator unit 2 perform identically to the first embodiment, except that here the mechanical actuator 28 of the actuator unit 2 is attached to a fuel supply valve 43 in such a way that the mechanical actuator 28 will rotate the valve 43 closed in response to a signal from the decoder 27, whereby the fuel supply 41 is shut off from the combustion unit 42.

Figure 3:
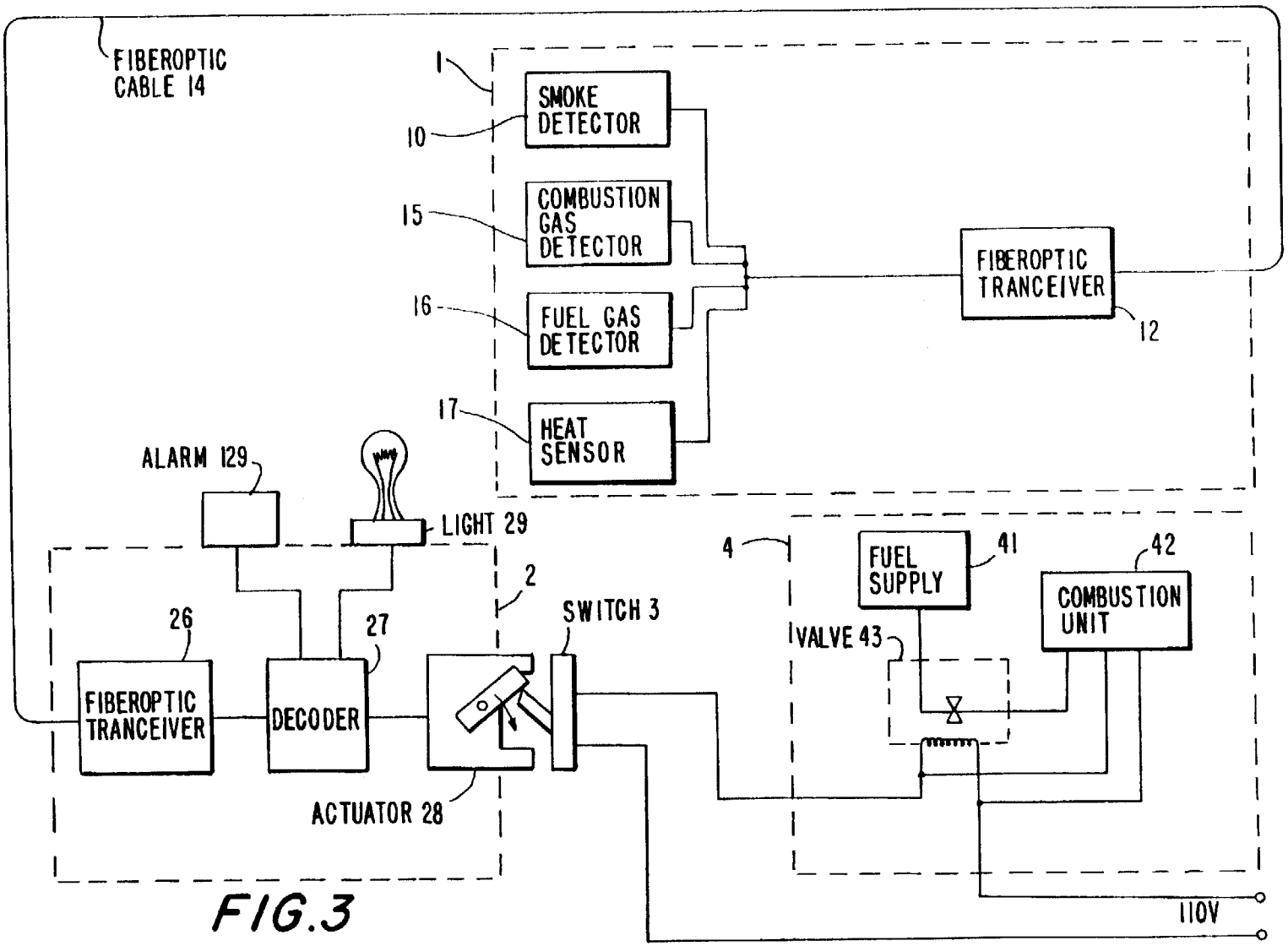
FIG. 3 is a block diagram of a safety shut-off apparatus for actuating an emergency cut-off switch of a combustion unit according to a third embodiment of the present invention.

FIG. 3 shows a third embodiment of the present invention. A condition detecting unit i is mounted near a home heating unit 4. When a faulty or dangerous condition is detected by the smoke detector 10, combustion gas detector 15, fuel gas detector 16 or heat sensor 17 in the condition detecting unit 1, a signal is sent to the fiber-optic transceiver 12. The fiber-optic transceiver 12 sends a signal through a fiber-optic cable 14 to the actuator unit 2 mounted to the existing manual shut-off switch 3. A second fiber optic transceiver 26 located in the actuator unit 2 receives the signal from the condition detecting unit 1 and sends a signal to the decoder 27. The decoder 27 compares the signal with the expected signal from the condition detecting unit 1 indicating that a dangerous or faulty condition exists. When the decoder receives a signal which indicates a dangerous or faulty condition exists it sends a signal to the mechanical actuator 28 which operates the existing cut-off switch 3 thereby cutting off the electrical power and/or fuel supply to the combustion unit 42. The decoder 27 also activates a signal light 29 and alarm 129 to alert the homeowner that a dangerous or faulty condition has occurred.

Under normal conditions the transceivers 12, 26 check the integrity of the fiber optic cable 14 by periodically sending test signals across it. If a test signal sent by the actuator unit 2 is not replied by the condition detecting unit 1, a signal is sent by the transceiver 26 to the decoder 27 which lights the warning light 29 and/or activates the alarm 129 warning the homeowner of faulty installation or of a break in the cable.

The electrically operated mechanical actuators which operate the existing power cut-off switch or fuel line valve may be of a design described in U.S. Pat. No. 5,189,392.

The above description is present by way of example only, but it will be apparent that many modifications and variations could be affected by one skilled in the art without departing from the spirit of the invention, which is to be defined by the appended claims.

What is claimed is:

1. A safety apparatus for shutting off a unit having a manually operated shut-off mechanism, comprising:

a) environmental condition sensing means for placement proximate the unit for sensing a selected condition;

b) signalling means connected to said sensing means for producing and transmitting an omnidirectional broadcast output signal consisting of a predetermined pattern of pulses when the selected condition exists;

c) receiving means for receiving said broadcast output signal transmitted from said signalling means and for checking for said predetermined pattern of pulses; and d) electrically operated actuating means connected to said receiving means for mechanically operating the shut-off mechanism of the unit when said receiving means finds said predetermined pattern of pulses in said broadcast output signal, whereby the unit is shut off.

2. A safety apparatus of claim 1 wherein said signalling means includes means for generating said predetermined pattern of pulses in the form of digital pulses and said receiving means includes means for recognizing the predetermined pattern of digital pulses in said broadcast output signal.

3. A safety apparatus of claim 1 wherein the broadcast output signal is an ultrasonic signal.

4. A safety apparatus of claim 1 wherein the broadcast output signal is an audible sound.

5. A safety apparatus of claim 1 wherein the broadcast output signal is an infrared light signal.

6. A safety apparatus of claim 1 wherein the broadcast output signal is a radio frequency signal.

7. A safety apparatus of claim 1 wherein the broadcast output signal is a microwave frequency signal.

8. A safety apparatus of claim 1 wherein multiple detector units may broadcast signals to said receiving means.

9. A safety apparatus for shutting off a unit having a manually operated shut-off mechanism, comprising:

environmental condition sensing means for placement proximate the unit for sensing a selected condition and producing a light signal suitable for communication through a fiber-optic cable indicative thereof;

a fiber-optic cable;

receiving means for receiving the light signal from the fiber-optic cable and generating an electrical signal; and electrically operated actuating means connected to said receiving means for mechanically operating the shut-off mechanism of the unit when said receiving means receives said light signal;

means for generating an alarm signal if the fiber-optic connection is broken, said means for generating including transceiver means attached to each end of the fiber-optic cable for communicating test signals along the cable; and alarm signaling means attached to at least one of the transceiver means for producing an alarm signal when said test signals are not successfully communicated along the fiber-optic cable.

* * * * *